US007778566B2

(12) United States Patent
Fukuta et al.

(10) Patent No.: US 7,778,566 B2
(45) Date of Patent: Aug. 17, 2010

(54) BELT CLEANING DEVICE AND IMAGE FORMING APPARATUS

(75) Inventors: Kazushi Fukuta, Kariya (JP); Tsunemitsu Fukami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 949 days.

(21) Appl. No.: 11/471,544

(22) Filed: Jun. 21, 2006

(65) Prior Publication Data

US 2006/0285872 A1 Dec. 21, 2006

(30) Foreign Application Priority Data

Jun. 21, 2005 (JP) ..... 2005-181071

(51) Int. Cl.
*G03G 21/00* (2006.01)

(52) U.S. Cl. ..... 399/99; 399/101

(58) Field of Classification Search ..... 399/71, 399/101, 345, 99

See application file for complete search history.

(56) References Cited

U.S. PATENT DOCUMENTS

| | | | | |
|---|---|---|---|---|
| 4,230,406 | A | 10/1980 | Klett et al. | |
| 5,333,041 | A * | 7/1994 | Ito et al. | 399/149 |
| 5,797,078 | A | 8/1998 | Sass et al. | |
| 6,049,684 | A | 4/2000 | Nishikawa et al. | |
| 6,477,344 | B1 * | 11/2002 | Asakura et al. | 399/101 |
| 6,480,695 | B2 | 11/2002 | Endo et al. | |
| 6,640,081 | B2 | 10/2003 | Sato | |
| 7,251,433 | B2 * | 7/2007 | Ai et al. | 399/101 |
| 7,526,221 | B2 * | 4/2009 | Mori | 399/71 |
| 2004/0253013 | A1 | 12/2004 | Furukawa | |
| 2005/0008404 | A1 | 1/2005 | Tomizawa | |
| 2005/0249514 | A1 | 11/2005 | Tomizawa | |

FOREIGN PATENT DOCUMENTS

| | | |
|---|---|---|
| JP | 2106780 | 4/1990 |
| JP | 2-78970 | 6/1990 |
| JP | 3130790 | 6/1991 |
| JP | 4-042271 A | 5/1992 |

(Continued)

OTHER PUBLICATIONS

EP Search Report, EP Appln. 06012553, mailed Sep. 18, 2006.

(Continued)

*Primary Examiner*—David P Porta
*Assistant Examiner*—Bryan P Ready
(74) *Attorney, Agent, or Firm*—Banner & Witcoff, Ltd.

(57) ABSTRACT

A belt cleaning device includes a cleaning roller, a backup roller, and a roller-pressing-state setting mechanism. The cleaning roller is disposed in confrontation with a surface of a belt. The backup roller is disposed in confrontation with the cleaning roller with the belt interposed between the cleaning roller and the backup roller. The roller-pressing-state setting mechanism selectively sets a state of the backup roller to a first state in which the backup roller is pressed against the cleaning roller via the belt, allowing a first pressure to be applied between the cleaning roller and the surface of the belt, and a second state in which a second pressure is applied between the cleaning roller and the surface of the belt. The second pressure is less than the first pressure.

12 Claims, 11 Drawing Sheets

FOREIGN PATENT DOCUMENTS

| | | | |
|---|---|---|---|
| JP | 4245283 | | 9/1992 |
| JP | 4301869 | | 10/1992 |
| JP | 5-193772 | A | 8/1993 |
| JP | 5303290 | | 11/1993 |
| JP | 11-095503 | A | 4/1999 |
| JP | 11-192768 | A | 7/1999 |
| JP | 2001-147598 | A | 5/2001 |
| JP | 2002031996 | | 1/2002 |
| JP | 2002031997 | | 1/2002 |
| JP | 2002-055536 | A | 2/2002 |
| JP | 2002162885 | | 6/2002 |
| JP | 2004294471 | | 10/2004 |

OTHER PUBLICATIONS

JP Office Action dtd Aug. 12, 2009, JP Appln. 2005-181071, English Translation.

* cited by examiner

BELT CLEANING DEVICE AND IMAGE FORMING APPARATUS

CROSS REFERENCE TO RELATED APPLICATIONS

This application claims priority from Japanese Patent Application No. 2005-181071 filed Jun. 21, 2005. The entire content of the priority application is incorporated herein by reference.

TECHNICAL FIELD

The disclosure relates to a belt cleaning device for cleaning a surface of a belt on which a conveying object is supported and conveyed. The disclosure also relates to an image forming apparatus for forming images with a developing agent such as toner.

BACKGROUND

Image forming apparatuses employing a conveying belt that supports and conveys sheets of paper for image formation are well known in the art. One such image forming apparatus disclosed in U.S. Patent Application Publication No. 2004/253013 (corresponding to Japanese Patent Application Publication No. 2004-294471) forms toner images on paper using a process unit for transferring the toner onto the paper as the paper is supported on a surface of the conveying belt and conveyed in a predetermined direction.

In the image forming apparatus described in U.S. Patent Application Publication No. 2004/253013, the conveying belt is a seamless, endless belt. A plurality of the process units is arranged along the conveying direction of the belt with each process unit disposed in confrontation with the surface of the conveying belt. The process units accommodate toner in one of the colors cyan, magenta, yellow, and black to support multicolor image formation.

The image forming apparatus disclosed in U.S. Patent Application Publication No. 2004/253013 performs a calibration process to correct problems in color registration. In this calibration process, the image forming apparatus forms a toner pattern on the surface of the conveying belt and detects the density of the pattern using a sensor disposed in confrontation with the surface of the conveying belt. The image forming apparatus also has a cleaning unit disposed near the sensor and confronting the surface of the conveying belt for removing the toner pattern after calibration. The cleaning unit includes an electrostatic brush disposed in confrontation with the surface of the conveying belt and capable of applying a predetermined bias voltage, a secondary roller using electrostatic attraction to remove toner deposited on the electrostatic brush, and a waste toner box encompassing the electrostatic brush and secondary roller for collecting waste toner.

SUMMARY

In view of the foregoing, it is an object of one aspect of the invention to provide a belt cleaning device employed in an image forming apparatus, in order to enhance durability of a belt and the belt cleaning device and to improve cleaning effectiveness of the belt.

In order to attain the above and other objects, the invention may provide a belt cleaning device for cleaning a surface of a belt that conveys a conveying object. The belt cleaning device includes a cleaning roller, a backup roller, and a roller-pressing-state setting mechanism. The cleaning roller is disposed in confrontation with the surface of the belt. The backup roller is disposed in confrontation with the cleaning roller with the belt interposed between the cleaning roller and the backup roller. The roller-pressing-state setting mechanism selectively sets a state of the backup roller to a first state in which the backup roller is pressed against the cleaning roller via the belt, allowing a first pressure to be applied between the cleaning roller and the surface of the belt, and a second state in which a second pressure is applied between the cleaning roller and the surface of the belt. The second pressure is less than the first pressure.

According to another aspect, the invention may also provide an image forming apparatus. The image forming apparatus includes an endless belt, a cleaning roller, a backup roller, and a roller-pressing-state setting mechanism. The endless belt has an outer surface. The endless belt conveys a conveying object on the outer surface. The cleaning roller is disposed in confrontation with the outer surface of the endless belt. The backup roller is disposed in confrontation with the cleaning roller with the endless belt interposed between the cleaning roller and the backup roller. The roller-pressing-state setting mechanism selectively sets a state of the backup roller to a first state in which the backup roller is pressed against the cleaning roller via the endless belt, allowing a first pressure to be applied between the cleaning roller and the outer surface of the endless belt, and a second state in which a second pressure is applied between the cleaning roller and the outer surface of the endless belt. The second pressure is less than the first pressure.

BRIEF DESCRIPTION OF THE DRAWINGS

Illustrative aspects in accordance with the invention will be described in detail with reference to the following figures wherein.

DETAILED DESCRIPTION

A belt cleaning device and an image forming apparatus according to illustrative aspects of the invention will be described while referring to FIGS. 1 through 2C.

<General Structure of a Laser Printer>

Figure 1:
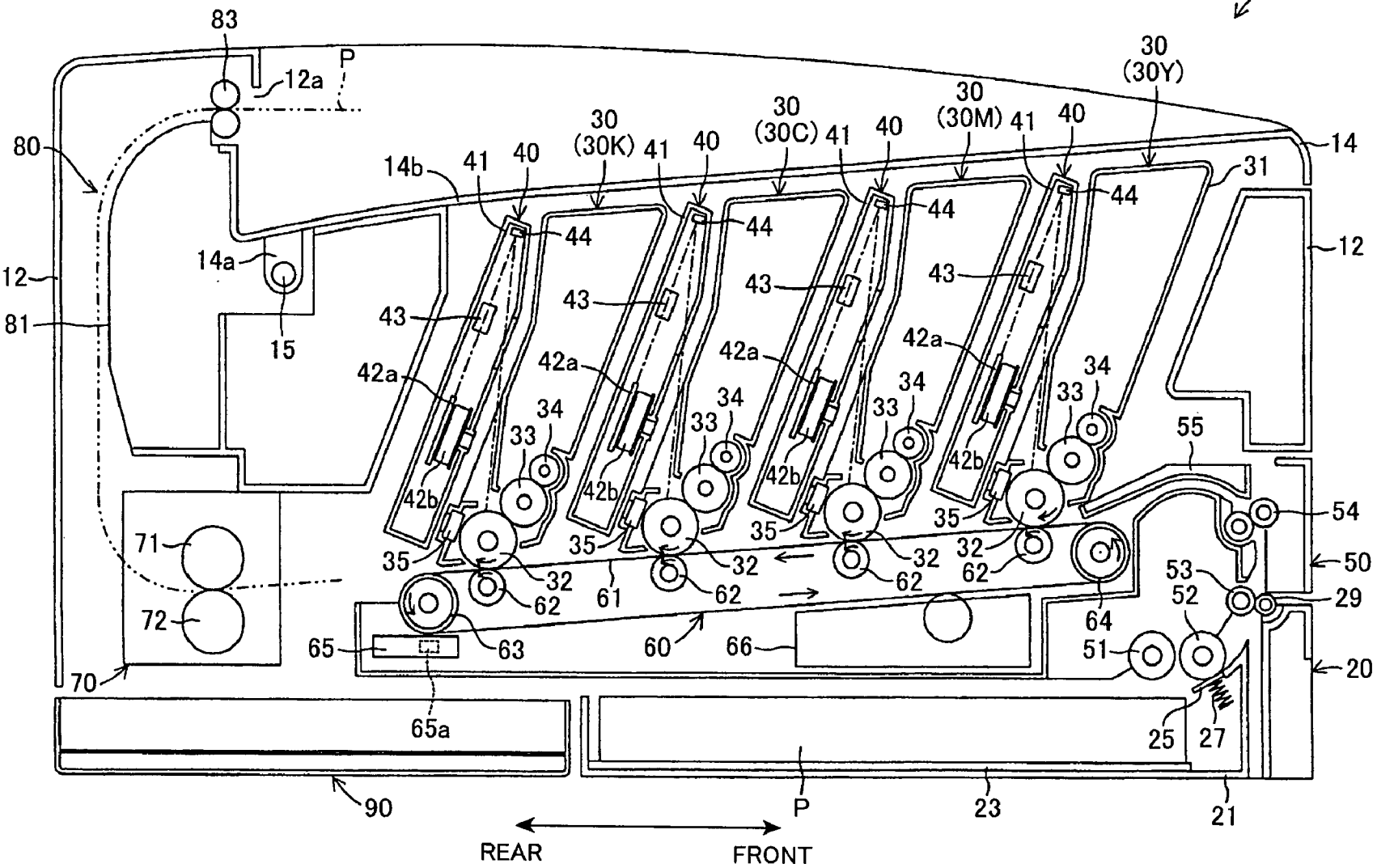
FIG. 1 is a vertical cross-sectional view of a laser printer according to illustrative aspects of the invention.

FIG. 1 is a side cross-sectional view of a laser printer 1 according to illustrative aspects of the invention. In the following description, the right side of the laser printer 1 in FIG. 1 will be referred to as the "front side," while the left side will be referred to as the "rear side." The expressions "front", "rear", "upper", and "lower" are used to define the various parts when the laser printer 1 is disposed in an orientation in which it is intended to be used.

The laser printer 1 includes a paper cassette 20, process cartridges 30, scanning units 40, a paper conveying unit 50, a transfer unit 60, a fixing unit 70, a discharge unit 80, and a control unit 90.

The laser printer 1 also includes a main casing 12 that is shaped to cover a main frame (not shown). The main frame functions to support a driving force transmitting mechanism configured of motors and gears. A top cover 14 is mounted on the top of the main casing 12. The top cover 14 has ribs 14*a* extending downward from lower edges of the top cover 14 on the rear side thereof and having through-holes formed near the bottom ends thereof. Support shafts protruding from the main casing 12 at positions corresponding to the ribs 14*a* are inserted through the through-holes formed in the ribs 14*a* for pivotally supporting the top cover 14. Hence, the top cover 14 can pivotally move open and closed over the main casing 12 about the support shafts. A discharge opening 12*a* is formed in the upper rear section of the main casing 12 above the rear side of the top cover 14. A discharge tray 14*b* is also formed on the top surface of the top cover 14 for supporting sheet-like paper P discharged through the discharge opening 12*a*.

<Paper Cassette>

The paper cassette 20 is detachably mounted in a lower section of the main casing 12. The paper cassette 20 is capable of accommodating a sheet-like paper P in a stacked state.

The paper cassette 20 includes a cassette case 21 forming the outer casing thereof, and a paper-pressing plate 23 and a separating pad 25 disposed within the cassette case 21. The paper-pressing plate 23 is a plate-shaped member that functions to support a stack of paper. The paper-pressing plate 23 is pivotally supported about an end on the rear side (the end farthest from the separating pad 25 in FIG. 1). A spring (not shown) is disposed beneath the front end of the paper-pressing plate 23 (the end nearest the separating pad 25 in FIG. 1) for urging the front end upward. The separating pad 25 is disposed near the front end of the cassette case 21 and downstream of the paper-pressing plate 23 in a paper-conveying direction. A compression spring 27 is disposed beneath the separating pad 25 for urging the separating pad 25 upward. The top surface of the separating pad 25 (the surface over which the paper P is conveyed) is a separating surface configured of a material having a higher coefficient of friction with the paper P than the coefficient of friction between two sheets of paper P (such as felt or rubber) The separating pad 25 functions to separate the sheets of paper P so that the paper P is conveyed toward an image forming unit (process cartridges 30 and the like) in the main casing 12 for image formation one sheet at a time.

A follow roller 29 is disposed in an upper end of the cassette case 21 on the front side thereof and at a position downstream of the separating pad 25 in the paper-conveying direction. The follow roller 29 rotates freely in the cassette case 21 and functions to guide sheets of the paper P separated by the separating pad 25 and conveyed one sheet at a time toward the image forming unit.

<Process Cartridges>

A plurality of the process cartridges 30 (30Y, 30M, 30C, and 30K) constituting the image forming unit are detachably mounted in the main casing 12 above the paper cassette 20. The process cartridges 30Y, 30M, 30C, and 30K are arranged in the order given from the front side to the rear side of the laser printer 1 and accommodate toner of the colors yellow, magenta, cyan, and black, respectively.

Each process cartridge 30 includes a cartridge case 31; and a photosensitive drum 32 on which latent images are formed, a developing roller 33 for bearing toner on the peripheral surface thereof to develop the latent images formed on the photosensitive drum 32, and a supply roller 34 for supplying toner to the peripheral surface of the developing roller 33, all of which are rotatably supported in the cartridge case 31.

In a side view, the photosensitive drum 32 is disposed in a longitudinal end of the cartridge case 31 (the bottom end in FIG. 1) so that a portion of the peripheral surface of the photosensitive drum 32 is exposed outside of the cartridge case 31 through an opening formed in the end of the cartridge case 31. The developing roller 33 is formed of a synthetic rubber material and is positioned so that the peripheral surface of the developing roller 33 contacts the photosensitive drum 32. The supply roller 34 is formed of a foam sponge material and contacts the developing roller 0.3.3 with pressure. The photosensitive drum 32, developing roller 33, and supply roller 34 are driven to rotate via the driving force transmitting mechanism provided in the main frame. Further, a predetermined developing bias voltage can be applied between the photosensitive drum 32 and developing roller 33. A charger 35 is disposed in confrontation with the peripheral surface of each photosensitive drum 32 at a position upstream of the area of contact between the photosensitive drum 32 and developing roller 33 with respect to the rotational direction of the photosensitive drum 32 (indicated by an arrow in FIG. 1). The charger 35 charges the peripheral surface of the photosensitive drum 32 with a uniform charge.

<Scanning Unit>

The scanning units 40 are provided inside the main casing 12 for each of the process cartridges 30 for irradiating a laser beam on the respective photosensitive drums 32 (indicated by a single-dot chain line in FIG. 1). Each scanning unit 40 includes a scanner case 41, a polygon mirror 42*a*, a polygon motor 42*b*, a lens 43, and a reflecting mirror 44. The polygon motor 42*b* is fixed to the scanner case 41 and has a drive shaft for supporting the polygon mirror 42*a*. The polygon motor 42*b* is capable of driving the polygon mirror 42*a* to rotate at a predetermined rotational speed. While the polygon motor 42*b* drives the polygon mirror 42*a* to rotate in this way, a laser light emitting unit (not shown) generates a laser beam based on image data The laser beam is deflected by the rotating polygon mirror 42*a* and scanned along a width direction of the paper. The lens 43 and reflecting mirror 44 are supported within the scanner case 41 and are aligned so that the laser beam deflected by the polygon mirror 42*a* is irradiated onto the peripheral surface of the photosensitive drum 32.

<Paper Conveying Unit>

The paper conveying unit 50 is disposed inside the main casing 12 for conveying the paper P toward the process cartridges 30. The paper conveying unit 50 includes a pickup roller 51, a feeding roller 52, a conveying roller 53, registration rollers 54, and a paper guide 55.

The pickup roller 51 is rotatably supported on the main frame (not shown). The pickup roller 51 is driven to rotate via the driving force transmitting mechanism provided on the main frame. During an image forming operation, the pickup roller 51 contacts with a predetermined pressure the stack of paper P urged upward by the paper-pressing plate 23. The feeding roller 52 is also rotatably supported in the main frame and is configured to rotate via the driving force transmitting mechanism. The feeding roller 52 is disposed in confrontation with the separating pad 25 so that the peripheral surface of the feeding roller 52 contacts the separating pad 25 with a predetermined force. The conveying roller 53 is rotatably supported in the main frame and a position opposing the follow roller 29 and farther frontward than the separating pad 25 (downstream of the separating pad 25 in the rotational direction of the feeding roller 52). The conveying roller 53 is driven to rotate via the driving force transmitting mechanism. The registration rollers 54 are also rotated via the driving force transmitting mechanism and function to adjust the direction and conveying timing of the paper P. The paper guide 55 functions to receive the paper P conveyed by the registration rollers 54 and to guide the paper P toward the process cartridges 30.

<General Structure of the Transfer Unit>

The transfer unit 60 is disposed inside the main casing 12 between the paper cassette 20 and the process cartridges 30. The transfer unit 60 includes a belt 61, transfer rollers 62, a drive roller 63, a support roller 64, a density-detecting unit 65, and a belt cleaner 66 serving as a belt cleaning device.

The belt 61 is formed of a synthetic resin, such as polycarbonate or polyimide, or an elastomer such as synthetic rubber. The belt 61 is formed without seams and has a longitudinal direction along the paper-conveying direction. The belt 61 is formed slightly wider than the width of a maximum sized sheet of paper P that can be used in the laser printer 1. Hence, when a sheet of maximum size is supported on the surface of the belt 61, the surface of the belt 61 is exposed on the widthwise sides of the paper P. In this description, the width of the belt 61 corresponding to the width of a maximum sized sheet of paper P will be referred to as the "effective width." As shown in FIG. 1, the belt 61 is looped around the transfer rollers 62, drive roller 63, and support roller 64 when viewed from the side.

The transfer rollers 62 are rotatably supported at positions confronting each of the photosensitive drums 32 provided in the process cartridges 30Y, 30M, 30C, and 30K, with the belt 61 interposed between the transfer rollers 62 and the photosensitive drums 32. Together with the process cartridges 30, the transfer rollers 62 constitute the image forming unit. A transfer bias voltage can be applied between the transfer rollers 62 and photosensitive drums 32 for transferring toner from the peripheral surface of the photosensitive drums 32 onto the surface of a sheet of paper P supported on the belt 61.

The drive roller 63 and support roller 64 are rotatably supported on a transfer unit frame (not shown) at positions that stretch the belt 61 taut in the paper-conveying direction. The drive roller 63 is driven to rotate in a direction indicated by the arrow in FIG. 1 via the driving force transmitting mechanism in order to move the belt 61 circularly in the direction indicated by arrows in FIG. 1. More specifically, the drive roller 63 is disposed near the black process cartridge 30K, positioned farthest rearward of the process cartridges 30, while the support roller 64 is disposed near the yellow process cartridge 30Y, positioned farthest frontward of the process cartridges 30. Hence, the belt 61 is supported on the drive roller 63 and support roller 64 below the process cartridges 30 and can support a sheet of paper P on a top surface (an outer surface 61*a* shown in FIGS. 2A and 2B) while moving along the array of photosensitive drums 32 provided in the process cartridges 30.

The density-detecting unit 65 is disposed below the drive roller 63 and has a reflective density sensor 65*a*. The reflective density sensor 65*a* generates signals corresponding to the density of toner on the surface of the belt 61 based on the intensity of light emitted from a light-emitting unit and the intensity of light reflected off the surface of the belt 61 and detected by a light-receiving unit. Hence, the reflective density sensor 65*a* can generate a signal indicating the toner density of marks formed on the belt 61, such as a toner pattern formed for calibrating density or for adjusting color registration in the paper-conveying direction (hereinafter, both will be referred to as "image calibration").

The belt cleaner 66 is disposed below the belt 61 and downstream of the density-detecting unit 65 with respect to the direction in which the belt moves on the lower side. The belt cleaner 66 is also positioned to confront the surface of the belt 61 in order to remove foreign matter that has deposited on the surface of the belt 61. A more detailed description of the belt cleaner 66 will be given later.

<Fixing Unit>

The fixing unit 70 is disposed inside the main casing 12 and downstream of the transfer unit 60 in the paper-conveying direction. The fixing unit 70 functions to fix a toner image formed on the surface of the paper P to the paper P. The fixing unit 70 includes a heating roller 71 and a pressure roller 72. The heating roller 71 is configured of a metal cylinder whose surface has been treated by a release agent, and a halogen lamp accommodated inside the cylinder The heating roller 71 is driven to rotate by the driving force transmitting mechanism. The pressure roller 72 is a roller formed of silicon rubber that is rotatably supported in confrontation with the heating roller 71. The pressure roller 72 presses against the heating roller 71 with a predetermined pressure and follows the rotation of the heating roller 71.

<Discharge Unit>

The discharge unit 80 is disposed inside the main casing 12 in a rearmost section thereof for discharging the paper P out of the laser printer 1 after the paper P has passed through the fixing unit 70. The discharge unit 80 includes a paper guide 81, and a pair of discharge rollers 83. The discharge rollers 83 are disposed near the discharge opening 12*a* and are driven to rotate by the driving force transmitting mechanism, The paper guide 81 functions to guide the paper P having passed through the fixing unit 70 to the discharge rollers 83.

<Control Unit>

The control unit 90 is accommodated in a lower section of the main casing 12. The control unit 90 is electrically connected to various motors provided on the main frame for driving various movable parts provided in the process cartridge 30 and paper conveying unit 50; actuators; sensors; the laser light emitting units and polygon motors 42*b* provided in the scanning units 40; and the like. Hence, the control unit 90 is capable of controlling the operations and timing of the process cartridge 30, scanning unit 40, paper conveying unit 50, transfer unit 60, fixing unit 70, and discharge unit 80.

<Detailed Structure of the Belt Cleaner>

Figure 2A:
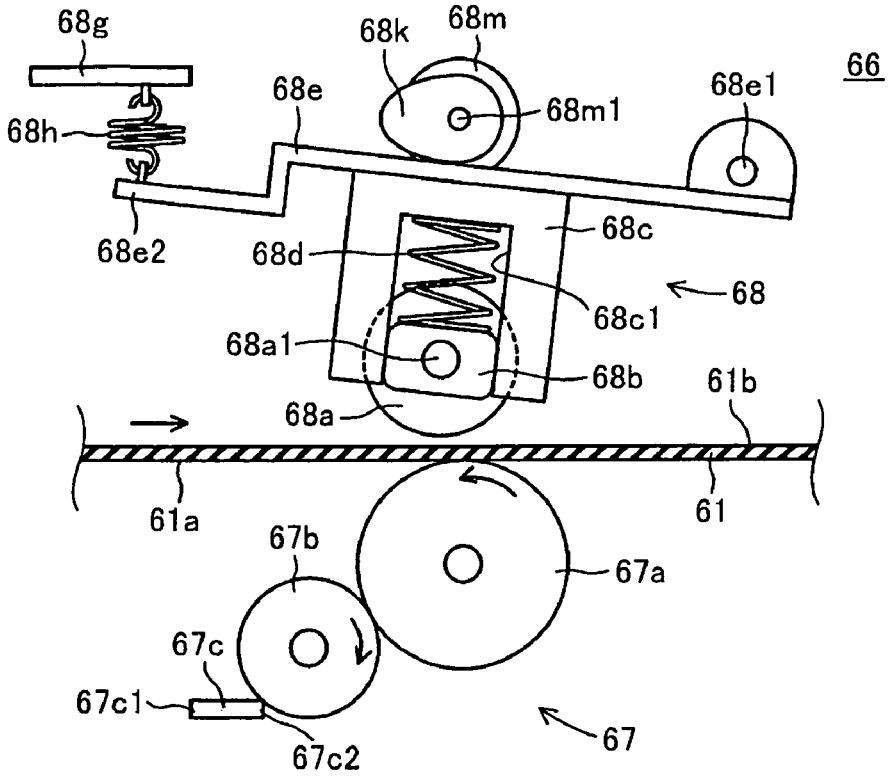
FIG. 2A is an enlarged cross-sectional view of the laser printer in FIG. 1 around a belt cleaner region in a pressing release state.
Figure 2B:
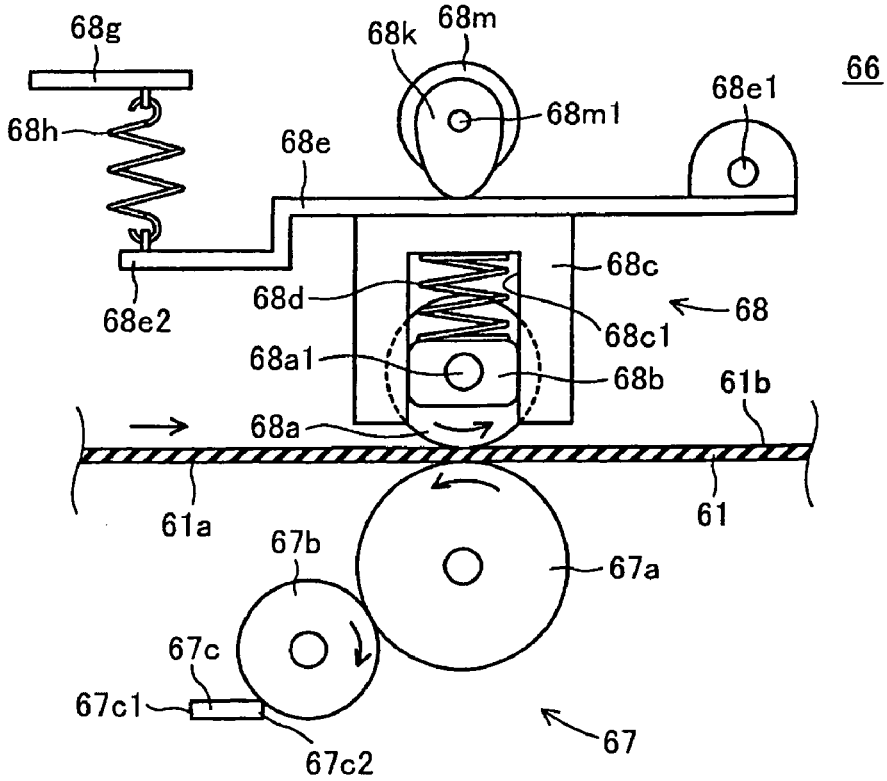
FIG. 2B is an enlarged cross-sectional view of the laser printer in FIG. 1 around the belt cleaner region in a pressing state.
Figure 2C:
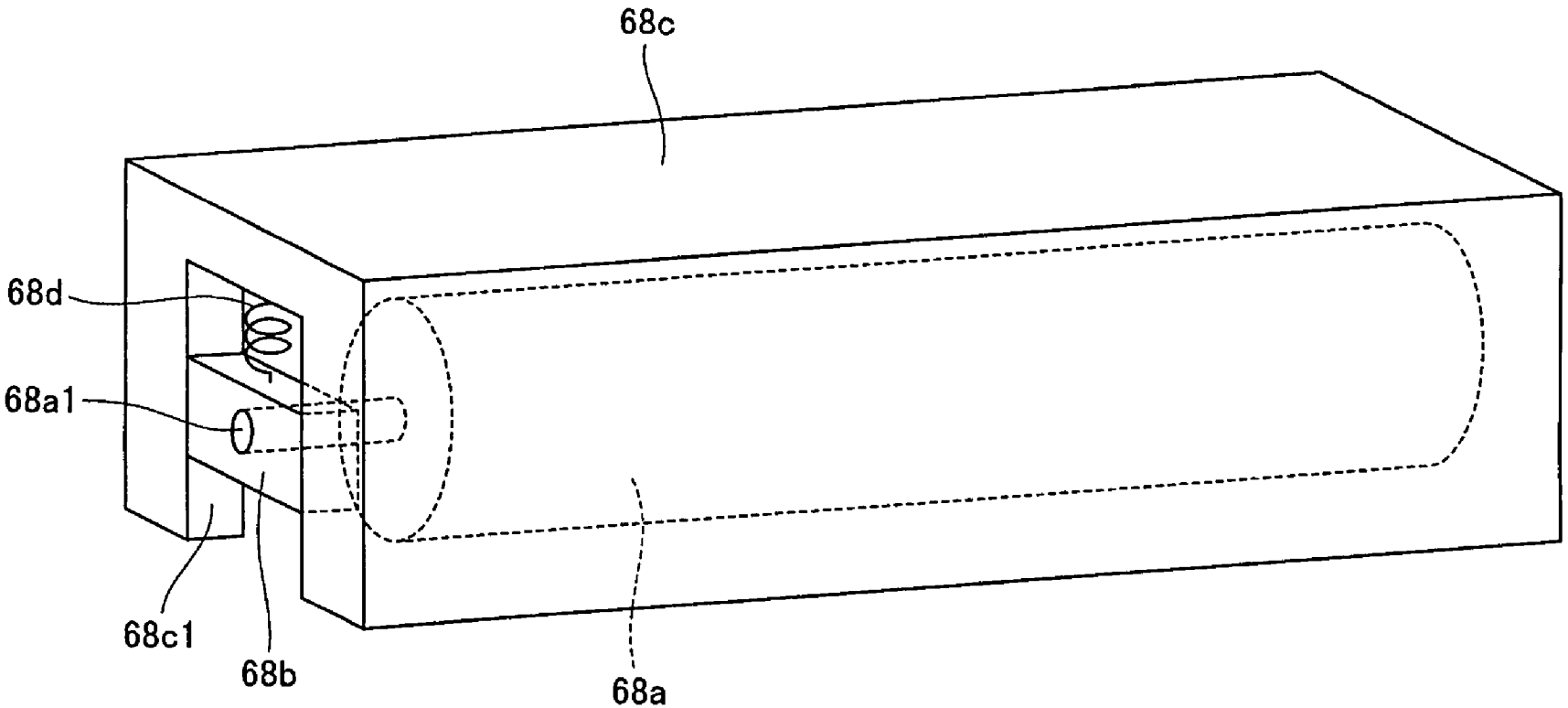
FIG. 2C is a perspective view schematically showing a roller shaft holder and a roller case of the belt cleaner.

FIGS. 2A and 2B are enlarged views of a region inside the laser printer 1 around the belt cleaner 66. FIG. 2C is a perspective view schematically showing a roller shaft holder 68*b* and a roller case 68*c* (described later) in the belt cleaner 66. The belt cleaner 66 is configured of a cleaning unit 67, and a backup unit 68 disposed so as to confront the cleaning unit 67 on the opposite side of the belt 61.

In the illustrative aspects, the cleaning unit 67 is disposed on the underside of the outer surface 61*a* of the belt 61 that supports the paper Further, like the transfer rollers 62 shown in FIG. 1, the backup unit 68 in the illustrative aspects is also disposed in the space encompassed by the belt 61.

<Cleaning Unit>

The cleaning unit 67 is configured of a cleaning roller 67*a*, a secondary roller 67*b*, and a cleaning blade 67*c*. When the backup unit 68 is in the state shown in FIG. 2A (i.e., when a backup roller 68*a* of the backup unit 68 described later is separated from an inner surface 61*b* of the belt 61), the belt 61 drops downward by its own weight. The cleaning roller 67*a* is positioned below the outer surface 61*a* of the belt 61 so that the outer surface 61*a* of the belt 61 is in constant contact with the cleaning roller 67*a*.

The cleaning roller 67*a* in the illustrative aspects is configured of a main roller member formed around a metal rotational shaft. The main roller member is formed primarily of a synthetic rubber mixed with carbon black so as to have a semiconductive property (with a resistance of approximately $10^5$ through $10^7$ ohms). The rotational shaft of the cleaning roller 67*a* is connected to an output terminal of a high-voltage power supply. The power supply applies a predetermined cleaning bias voltage (such as −1.4 kV) between the cleaning roller 67*a* and the backup roller 68*a*, which is grounded.

The secondary roller 67*b* is a metal roller member disposed diagonally below the cleaning roller 67*a* so as to contact the same. The secondary roller 67*b* is connected to an output terminal of a high-voltage power supply. The power supply applies a predetermined secondary cleaning bias voltage between the secondary roller 67*b* and the cleaning roller 67*a*. For example, the predetermined secondary cleaning bias voltage is −0.8 kV so that the potential of the secondary roller 67*b* with respect to ground potential is −2.2 kV.

In the illustrative aspects, the cleaning roller 67*a* and secondary roller 67*b* are supported on the transfer unit frame mentioned above and can be driven to rotate in the direction of the arrows shown in FIGS. 2A and 2B. Hence, the belt cleaner 66 of the illustrative aspects is configured so that the peripheral surface of the cleaning roller 67*a* where the cleaning roller 67*a* contacts the outer surface 61*a* of the belt 61 (i.e., a tangent to the cleaning roller 67*a* at the position of contact) moves opposite (in a direction counter to) the moving direction of the belt 61 at the position of contact, as indicated by arrows in FIGS. 2A and 2B. In other words, the belt cleaner 66 of the illustrative aspects is configured such that the cleaning roller 67*a* is driven to rotate in a counter direction to the moving direction of the belt 61.

In the illustrative aspects, the rubber cleaning blade 67*c* is disposed in contact with the peripheral surface of the secondary roller 67*b*. The cleaning blade 67*c* contacts the peripheral surface of the secondary roller 67*b* in a direction counter to the rotation of the secondary roller 67*b*. More specifically, the cleaning blade 67*c* has a base end 67*c*1 and a free end 67*c*2. The base end 67*c*1 of the cleaning blade 67*c* is supported on the transfer unit frame so that the free end 67*c*2 on the end opposite the base end 67*c*1 contacts the secondary roller 67*b*. The direction that the cleaning blade 67*c* extends from the base end 67*c*1 to the free end 67*c*2 is opposite, or counter to, the rotational direction of the secondary roller 67*b* at the point of contact with the free end 67*c*2. The cleaning blade 67*c* is in a substantially horizontal orientation at a position lower than the rotational axis of the secondary roller 67*b* so that the free end 67*c*2 contacts the peripheral surface of the secondary roller 67*b* downstream of the lowest point of the secondary roller 67*b* in the rotational direction of the same.

<Backup Unit>

When the belt 61 is being moved circularly, the backup unit 68 can selectively set the position of the backup roller 68*a* between a separated position (a pressing release state shown in FIG. 2A) in which the backup roller 68*a* is separated a predetermined distance from the inner surface 61*b* of the belt 61, and a pressing position (a pressing state shown in FIG. 2B) in which the backup roller 68*a* presses against the cleaning roller 67*a* via the belt 61.

The backup unit 68 includes the roller shaft holders 68*b*. The roller shaft holders 68*b* are provided on each end of the backup roller 68*a*. As shown in FIGS. 2A through 2C, the roller shaft holders 68*b* are shaped substantially like rectangular parallelepipeds and have a through-hole formed substantially in the center when viewed from the side. A rotational shaft 68*a*1 is provided in the center of the backup roller 68*a* and protrudes from both ends thereof. The both ends of the rotational shaft 68*a*1 are rotatably inserted into the through-holes formed in the roller shaft holders 68*b*. As shown in FIG. 2C, the backup unit 68 also includes the roller case 68*c* that houses the backup roller 68*a*. The roller case 68*c* is substantially box-shaped and open on the bottom. A lower portion of the backup roller 68*a* is exposed at the bottom opening of the roller case 68*c*. Grooves 68*c*1 are formed in each side wall of the roller case 68*c* (walls on both ends of the roller case 68*c* with respect to the paper width direction). Each groove 68*c*1 extends substantially in a vertical direction. Each groove 68*c*1 accommodates the roller shaft holder 68*b* and is capable of guiding the roller shaft holder 68*b* in a substantially vertical direction. Compression springs 68*d* are configured of coil springs. Each compression spring 68*d* has a bottom end fixed to the top end of one of the roller shaft holders 68*b* and a top end fixed to an upper portion of the roller case 68*c*.

As shown in FIG. 2B, the compression springs 68*d* function to press the backup roller 68*a* toward the belt 61 and cleaning roller 67*a* by urging the backup roller 68*a* downward via the roller shaft holders 68*b* such that the backup roller 68*a* is in contact with the inner surface 61*b* of the belt 61.

The top end of the roller case 68*c* is fixed to a bottom surface of a roller case holder 68*e*. The roller case holder 68*e* is a plate-shaped member having a pivot shaft 68*e*1 provided on one end thereof. The roller case holder 68*e* also has a free end 68*e*2 opposite the pivot shaft 68*e*1. The roller case holder 68*e* is supported on the transfer unit frame via the pivot shaft 68*e*1 so as to be capable of pivoting about the pivot shaft 68*e*1 for raising and lowering the free end 68*e*2 in a substantially vertical direction. A spring holder 68*g* formed of a plate-shaped member is supported on the transfer unit frame above the free end 68*e*2. A raising spring 68*h* configured of a coil spring (tension spring) is connected between the spring holder 68*g* and the free end 68*e*2 of the roller case holder 68*e* for urging the free end 68*e*2 upward.

A cam 68*k* is disposed at a substantially central position between the pivot shaft 68*e*1 and free end 68*e*2 of the roller case holder 68*e* so as to contact the top surface of the roller case holder 68*e*. The cam 68*k* is fixed to a rotational shaft 68*m*1 of a motor 68*m*. The rotational shaft 68*m*1 of the motor 68*m* extends parallel to the pivot shaft 68*e*1. The motor 68*m* is a stepping motor connected to the control unit 90 described above (see FIG. 1). The control unit 90 controls the driving state of the motor 68*m* based on a rotational phase of the rotational shaft 68*m*1 indicated by an encoder or the like (not shown).

Specifically, the backup unit 68 is configured to place the backup roller 68*a* in a "separated position" separated from the inner surface 61*b* of the belt 61, as shown in FIG. 2A, when conveying the belt 61 for performing a normal image forming operation on paper. The backup unit 68 is also configured to place the backup roller 68*a* in a "pressing position" in which the backup roller 68*a* elastically presses against the belt 61 and cleaning roller 67*a*, as shown in FIG. 2B, when marks for image calibration are detected by the density-detecting unit 65.

<Operations and Effects of the Illustrative Aspects>

Next, the operations and effects of the illustrative aspects described above will be described while referring to the accompanying drawings. During image calibration with the laser printer 1 of the illustrative aspects shown in FIGS. 1 through 2C, the process cartridge 30, scanning unit 40, and transfer unit 60 are driven as follows under the control of the control unit 90.

At the beginning of an image calibration operation, the control unit 90 first begins driving the drive roller 63 in the transfer unit 60 and the photosensitive drum 32, developing roller 33, and supply roller 34 in the process cartridges 30. The control unit 90 begins supplying a voltage to the cleaning roller 67*a* and secondary roller 67*b* for generating a cleaning bias voltage and a secondary cleaning bias voltage.

At this time, as shown in FIG. 2A, the control unit 90 sets the rotational phase of the motor 68*m* so that the small diameter portion of the cam 68*k* confronts the roller case holder 68*e*. Consequently, the roller case holder 68*e* is pulled upward by the restoring force of the raising spring 68*h* so that the backup roller 68*a* separates from the belt 61. The belt 61 is conveyed in the direction indicated by the arrow in FIG. 2A, while the outer surface 61*a* lightly contacts the cleaning roller 67*a* owing to the weight of the belt 61.

Accordingly, the stress state of the belt 61 (the tension in the belt 61 and the state of contact and friction with the rollers) is set to the minimum degree required for ensuring that the belt 61 is conveyed with stability and without slipping over the drive roller 63 and support roller 64 shown in FIG. 1. While the stress on the belt 61 is greatly reduced in this way, the cleaning roller 67*a* removes easy-to-remove foreign matter such as paper dust, that is deposited on the outer surface 61*a* of the belt 61.

Next, the control unit 90 activates the scanning unit 40 at an appropriate timing for forming an electrostatic latent image on the photosensitive drum 32 corresponding to calibration marks. The latent image is developed with toner borne on the surface of the developing roller 33 and the developed image is transferred onto the belt 61 by the transfer bias. As a result, the belt 61 bears calibration marks formed in toner on the surface thereof. The calibration marks move along with the surface of the belt 61 as the belt 61 moves circularly by the rotation of the drive roller 63. As the calibration marks pass a detection position at a position opposite the reflective density sensor 65*a* shown in FIG. 1, the density-detecting unit 65 generates a signal corresponding to the density of toner in the calibration marks. The control unit 90 then adjusts the image based on this signal. For example, the control unit 90 may adjust the developing bias or transfer bias based on the toner density.

Immediately after the density-detecting unit 65 detects the calibration marks formed on the outer surface 61*a* of the belt 61, the control unit 90 rotates the motor 68*m* until the large diameter portion of the cam 68*k* confronts the roller case holder 68*e*, as shown in FIG. 2B. The cam 68*k* forces the roller case holder 68*e* against the upward urging force of the raising spring 68*h* so that the roller case holder 68*e* pivots downward about the pivot shaft 68*e*1. While being urged downward by the compression springs 68*d*, the backup roller 68*a* is pressed against the belt 61 and cleaning roller 67*a*. Hence, the cleaning roller 67*a* can reliably remove toner forming the calibration marks that firmly adheres to the outer surface 61*a* of the belt 61 through electrostatic attraction.

Subsequently, the control unit 90 again drives the motor 68*m* to return the backup roller 68*a* to the separated position shown in FIG. 2A. This process is performed at a predetermined timing after the cleaning roller 67*a* has completely removed the calibration marks from the outer surface 61*a* of the belt 61, that is, a predetermined time after the density-detecting unit 65 generates the signal corresponding to the toner density of the calibration marks.

The secondary cleaning bias voltage applied between the secondary roller 67*b* and cleaning roller 67*a* causes the foreign matter removed by the cleaning roller 67*a* to transfer onto the secondary roller 67*b*. Subsequently, the free end 67*c*2 of the cleaning blade 67*c* scrapes the foreign matter off the secondary roller 67*b* so that the foreign matter falls diagonally downward (i.e., front-downward).

In the illustrative aspects described above, the backup roller 68*a* actively presses against the cleaning roller 67*a* only when removing toner forming calibration marks that firmly adheres to the outer surface 61*a* of the belt 61 through electrostatic attraction. At all other times, the backup roller 68*a* does not actively press against the cleaning roller 67*a*. This construction enables the cleaning roller 67*a* to clean the belt 61 based on the condition of the foreign matter deposited on the outer surface 61*a* of the belt 61, while enhancing the durability of the belt 61, cleaning roller 67*a*, and the like. The construction also reduces power consumption by reducing the torque of the motor for driving the rollers to rotate.

A particular feature of the illustrative aspects is that the backup roller 68*a* is separated from the inner surface 61*b* of the belt 61 to disengage the backup roller 68*a* from actively pressing against the cleaning roller 67*a*. This construction minimizes the stress applied to the belt 61 when the backup roller 68*a* is not actively applying pressure, thereby further enhancing the durability of the belt 61.

In the illustrative aspects described above, the cleaning roller 67*a* is driven to rotate in a direction counter to the moving direction of the belt 61. In this way, a frictional force of a direction opposite the moving direction of the belt 61 is applied to the foreign matter deposited on the outer surface 61*a* of the belt 61 at the point of contact. Further, a larger surface area on the periphery of the cleaning roller 67*a* can contact a unit area of the outer surface 61*a* of the belt 61 in the contact position, where the unit area is a product of the conveying distance of the belt 61 per unit time and the effective width of the belt 61. Hence, the cleaning roller 67*a* can effectively remove foreign matter deposited on the outer surface 61*a* of the belt 61.

<Modifications of the Backup Unit>

Next, modifications in the structure of the backup unit will be described, wherein like parts and components are designated with the same reference numerals to avoid duplicating description.

<First Modification>

Figure 3A:
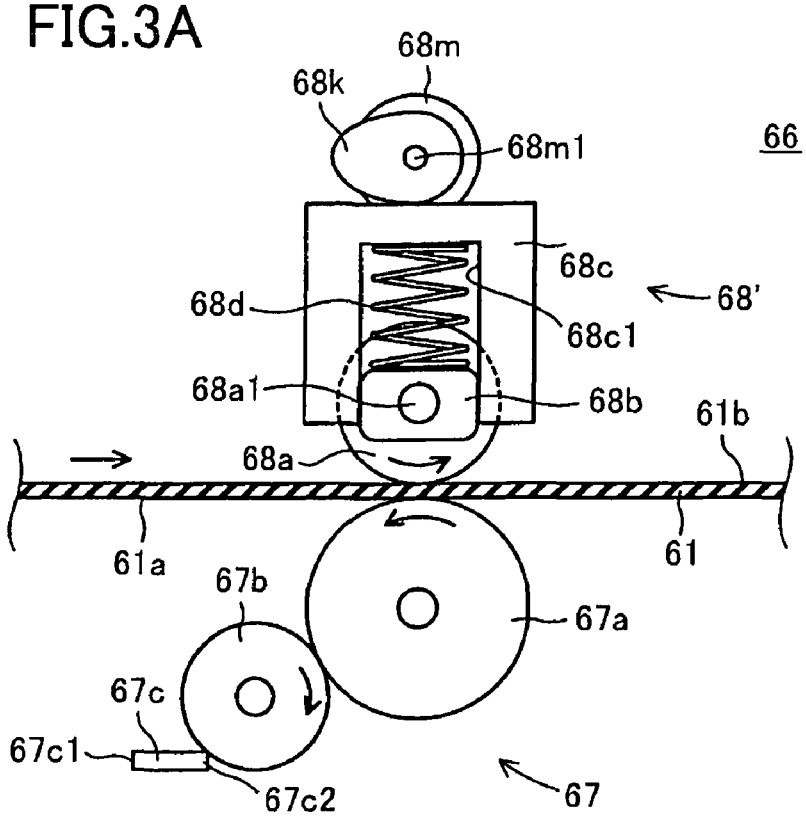
FIG. 3A is an enlarged cross-sectional view of a belt cleaner in a pressing release state according to a first modification of a backup unit.
Figure 3B:
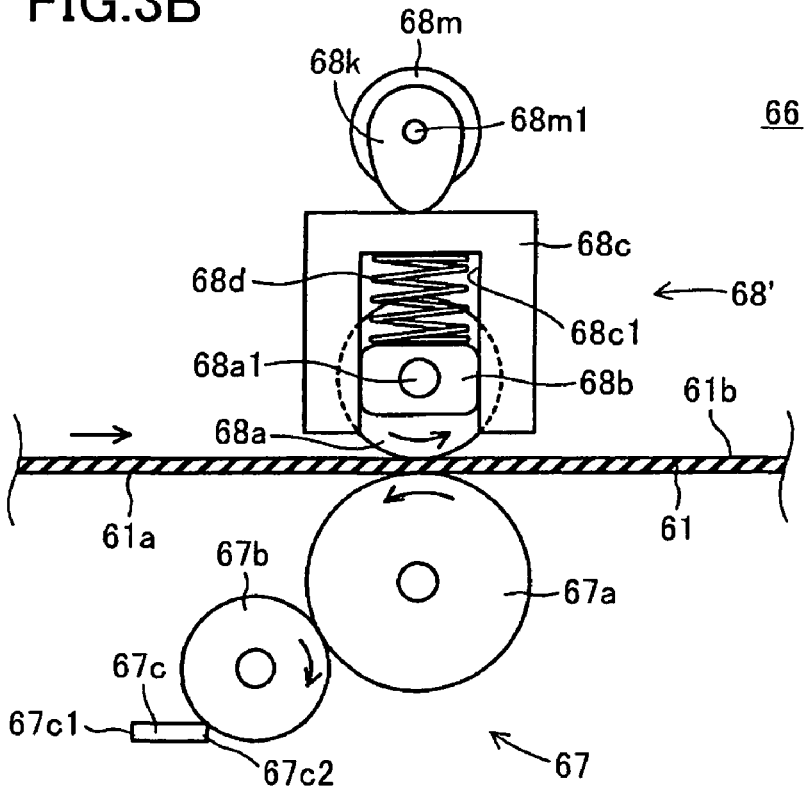
FIG. 3B is an enlarged cross-sectional view of the belt cleaner in a pressing state according to the first modification of the backup unit.

FIGS. 3A and 3B show a backup unit 68' according to a first modification. As in the illustrative aspects described above, the cleaning roller 67*a* is positioned on the underside of the outer surface 61*a* of the belt 61. Further, the backup roller 68*a* is disposed above the belt 61 and cleaning roller 67*a* and confronts the cleaning roller 67*a* with the belt 61 interposed therebetween.

A feature of this modification is that the backup roller 68*a* is pressed downward toward the belt 61 by its own weight when the backup unit 68' is in the pressing release state shown in FIG. 3A. Accordingly, the backup roller 68*a* is in constant contact with the inner surface 61*b* of the belt 61. The downward force of the backup roller 68*a* caused by its own weight is attenuated by the compression springs 68*d*, which stretch farther than their natural length when the backup unit 68' is in the pressing release state shown in FIG. 3A.

In this modification, the roller case 68*c* is supported on the transfer unit frame (not shown) so as to be capable of reciprocating up and down. When the backup unit 68' is in the pressing state shown in FIG. 3B, the large diameter portion of the cam 68*k* presses directly downward against the top of the roller case 68*c*. Hence, the roller case holder 68*e*, spring holder 68*g*, and raising spring 68*h* of the illustrative aspects in FIGS. 2A and 2B have been eliminated from this structure.

In the first modification, the position of the backup roller 68*a* changes very little between the pressing release state of FIG. 3A and the pressing state of FIG. 3B. Specifically, when setting the backup roller 68*a* in the pressing state shown in FIG. 3B, the backup roller 68*a* is displaced only slightly downward, owing to the elastic deformation of the belt 61 and cleaning roller 67*a* caused by the increased pressure.

When the backup unit 68' is in the pressing release state shown in FIG. 3A, the backup roller 68*a* is urged against the belt 61 and cleaning roller 67*a* by its own weight, supported partially by the compression springs 68*d*. Accordingly, a weak pressure based on the weight of the belt 61 and the attenuated weight of the backup roller 68*a* is applied between the outer surface 61*a* of the belt 61 and the cleaning roller 67*a*. Through this force, the cleaning roller 67*a* can more reliably remove paper dust and other easy-to-remove foreign matter deposited on the outer surface 61*a* of the belt 61. However, the state of the backup roller 68*a* is switched to the pressing state shown in FIG. 3B when removing toner adhered to the outer surface 61*a* of the belt 61. In this way, the cleaning roller 67*a* can reliably remove toner forming calibration marks that firmly adheres to the outer surface 61*a* of the belt 61 through electrostatic attraction.

<Second Modification>

Figure 4A:
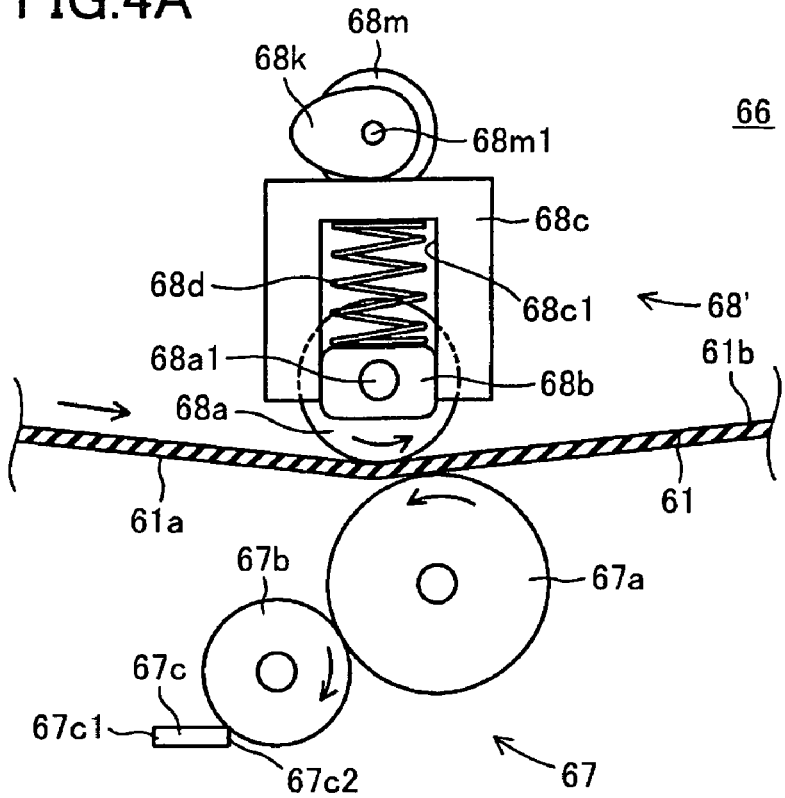
FIG. 4A is an enlarged cross-sectional view of a belt cleaner in a pressing release state according to a second modification of a backup unit.
Figure 4B:
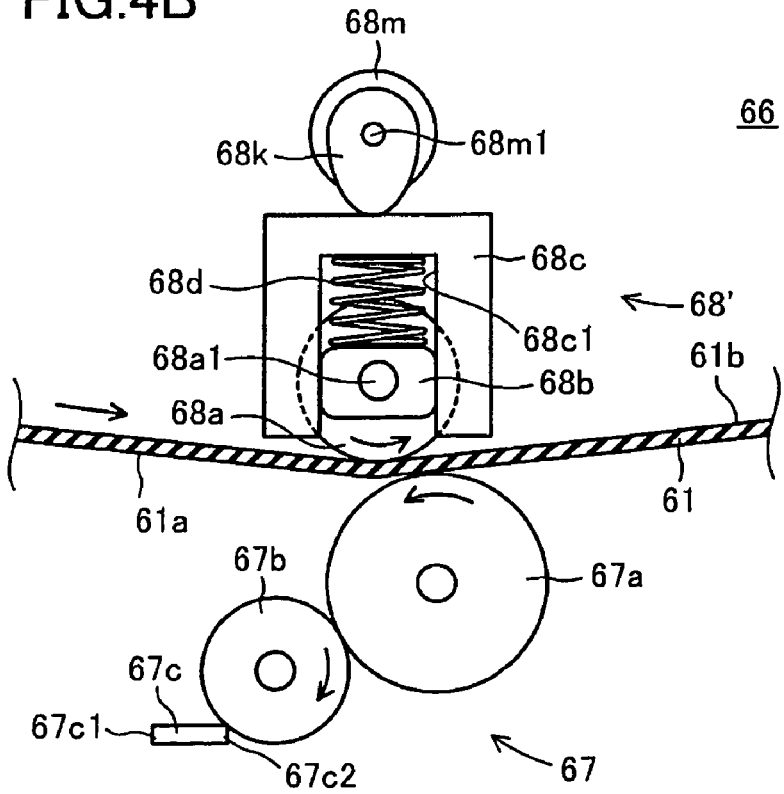
FIG. 4B is an enlarged cross-sectional view of the belt cleaner in a pressing state according to the second modification of the backup unit.

FIGS. 4A and 4B show the backup unit 68' according to a second modification, wherein the backup roller 68*a* is positioned to always bow the belt 61 toward the cleaning roller 67*a*. In other words, the backup roller 68*a* functions as a tension roller for applying tension to the belt 61. This construction simplifies the structure of the device by eliminating the need for a separate tension roller. When the backup unit 68' is in the pressing release state shown in FIG. 4A, the backup roller 68*a* applies the minimum pressure required for ensuring smooth conveyance of the belt 61. Accordingly, the backup roller 68*a* can constantly apply pressure without degrading the durability of the belt 61.

In the backup unit 68' according to the second modification, the centers of the cleaning roller 67*a* and backup roller 68*a* are offset in the paper-conveying direction. This construction increases the area of contact between the outer surface 61*a* of the belt 61 and the cleaning roller 67*a*, improving cleaning efficiency. In particular, a relatively large amount of surface area on the outer surface 61*a* is placed in contact with the cleaning roller 67*a* in the pressing state shown in FIG. 4B. In this case, the cleaning roller 67*a* (and the backup roller 68*a*) actively press against the outer surface 61*a* (and inner surface 61*b*) of the belt 61. Accordingly, the cleaning roller 67*a* can even more reliably remove toner forming calibration marks that adheres firmly to the outer surface 61*a* through electrostatic attraction.

<Third Modification>

Figure 5A:
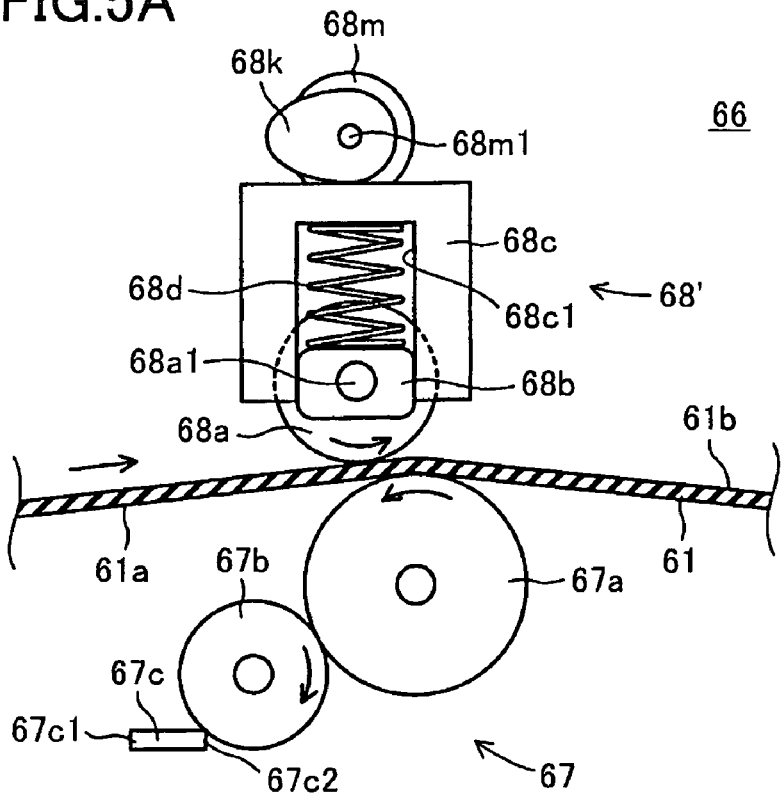
FIG. 5A is an enlarged cross-sectional view of a belt cleaner in a pressing release state according to a third modification of a backup unit.
Figure 5B:
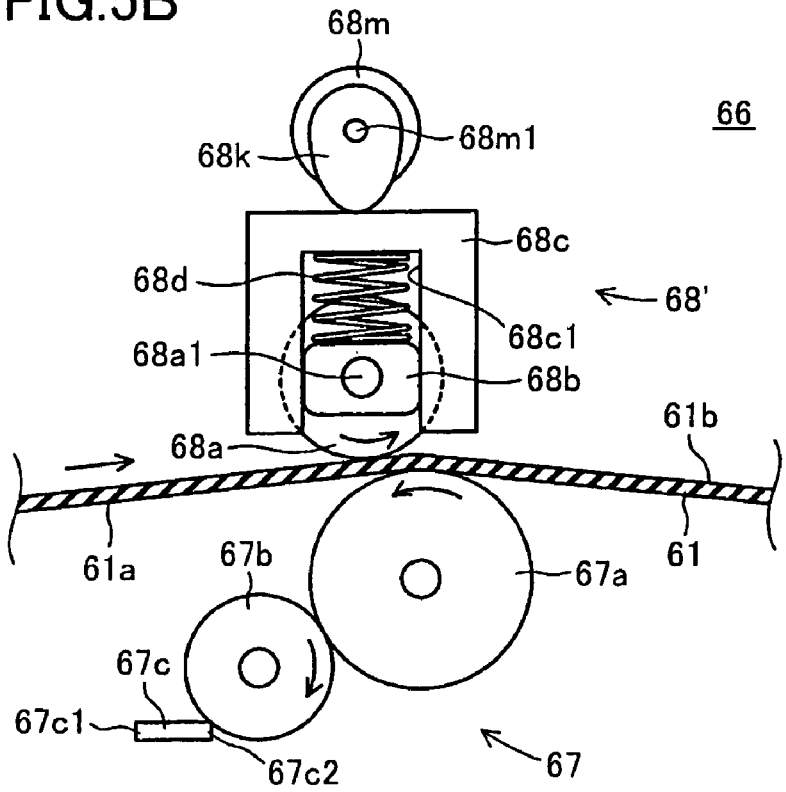
FIG. 5B is an enlarged cross-sectional view of the belt cleaner in a pressing state according to the third modification of the backup unit.

In a third modification shown in FIGS. 5A and 5B, the cleaning roller 67*a* functions as the tension roller described above instead of the backup roller 68*a* in the second modification shown in FIGS. 4A and 4B. In other words, the cleaning unit 67 is urged by a spring well known in the art (not shown) toward the belt 61 to bow the belt 61. This construction has the same operations and effects as that in the second modification described above.

As an alternative to urging the cleaning unit 67 toward the belt 61 with a spring, it is possible to urge the support roller 64 toward the belt 61 (rightward in FIG. 1, for example) with a spring well known in the art in order to apply tension to the belt 61. In this case, the cleaning unit 67 is fixed to the belt cleaner 66 (main casing 12) so that the cleaning roller 67*a* bows the belt 61. Alternatively, both the cleaning unit 67 and support roller 64 may be urged toward the belt 61 with springs.

<Modifications of the Cleaning Unit Structure>

Figure 6A:
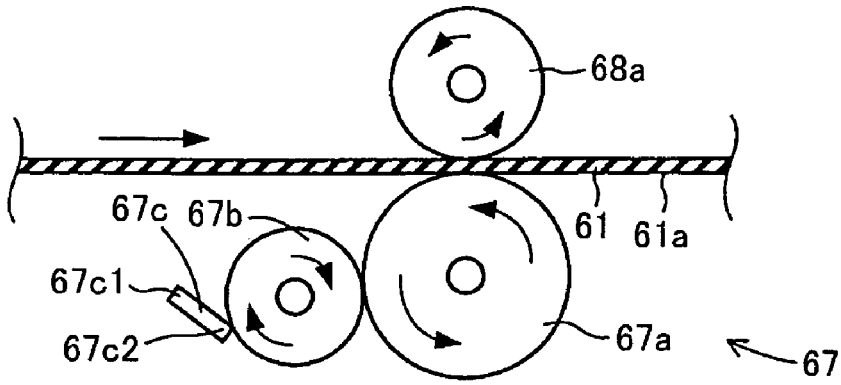
FIG. 6A is an enlarged cross-sectional view of a belt cleaner according to a modification of a cleaning unit.

Next, modifications of the cleaning unit will be described with reference to FIGS. 6A through 6D. FIG. 6A shows a cleaning unit having a similar structure to that in the illustrative aspects shown in FIGS. 2A and 2B. However, while the cleaning blade 67*c* is substantially horizontal in orientation in the cleaning unit of FIGS. 2A and 2B, the cleaning blade 67*c* in this modification is oriented with the base end 67*c*1 positioned slightly above the free end 67*c*2. With this construction, foreign matter transferred onto the secondary roller 67*b* falls diagonally downward (i.e., front-downward) when scraped off by the free end 67*c*2 of the cleaning blade 67*c*.

In the cleaning unit 67 of the illustrative aspects shown in FIGS. 2A and 2B, the secondary roller 67*b* is configured so that its lower end protrudes farther downward than the lower end of the cleaning roller 67*a*. However, in the structure shown in FIG. 6A, the lower end of the secondary roller 67*b* does not protrude lower than the lower edge of the cleaning roller 67*a* but is positioned at substantially the same height or slightly higher than the lower edge of the cleaning roller 67*a*. Further, the cleaning blade 67*c* in the structure shown in FIG. 6A does not protrude farther downward than the lower edge of the secondary roller 67*b*. Hence, the cleaning unit 67 having this structure is more compact in the height dimension, making it possible to produce a more compact laser printer 1.

Figure 6B:
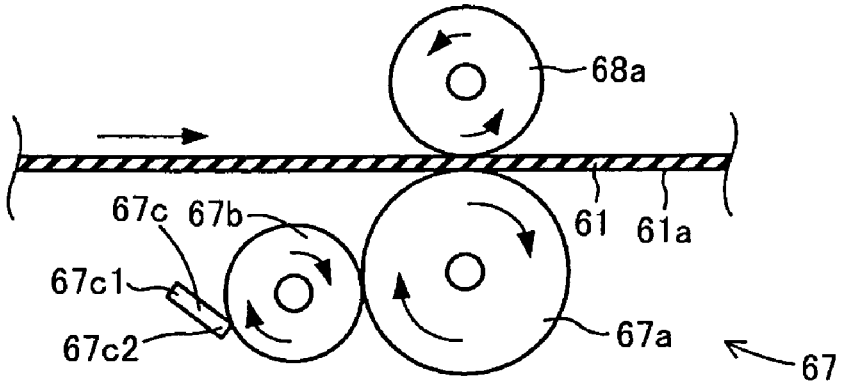
FIG. 6B is an enlarged cross-sectional view of the belt cleaner shown in FIG. 6A, in which a cleaning roller rotates in an opposite direction.

The cleaning unit 67 shown in FIG. 6B has an identical structure to that in FIG. 6A, except that the cleaning roller 67*a* rotates in the opposite direction. This construction has the same operations and effects as those in FIG. 6A.

Figure 6C:
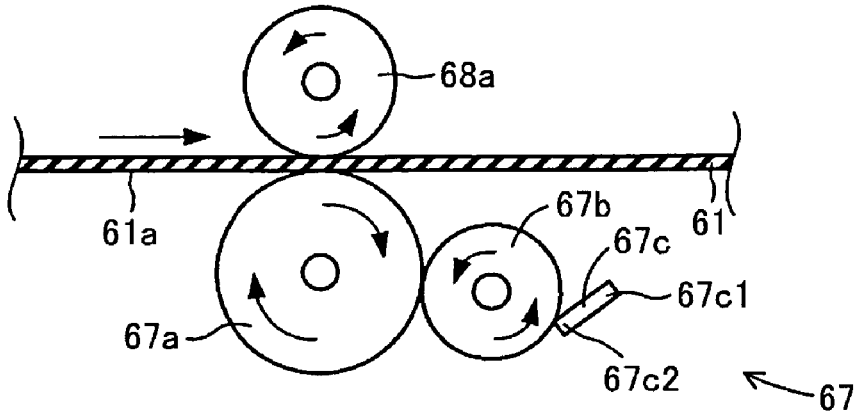
FIG. 6C is an enlarged cross-sectional view of a belt cleaner according to another modification of a cleaning unit.

In the cleaning unit 67 shown in FIG. 6C, the positions of the secondary roller 67*b* and cleaning blade 67*c* are opposite those in FIG. 6B so that the secondary roller 67*b* is downstream of the cleaning roller 67*a* in the conveying direction of the belt 61. Further, the rotating direction of the secondary roller 67*b* is opposite that in the structure of FIG. 6B. In this construction, the cleaning blade 67*c* is also slanted in the opposite direction so as to contact the secondary roller 67*b* in a direction counter to the rotating direction of the secondary roller 67*b*. Accordingly, the free end 67*c*2 of the cleaning blade 67*c* scrapes off foreign matter transferred onto the secondary roller 67*b* in a direction diagonally upstream in the conveying direction of the belt 61. In other words, foreign matter scraped off of the secondary roller 67*b* by the free end 67*c*2 of the cleaning blade 67*c* falls diagonally downward and upstream in the conveying direction of the belt 61 (i.e., rear-downward). Accordingly, it is possible to suppress foreign matter from scattering downstream of the cleaning roller 67*a* in the conveying direction of the belt 61 (that is, toward the cleaning side), thereby more effectively cleaning the belt 61. As described above, this construction can also reduce the size of the cleaning unit 67 in the height dimension.

Figure 6D:
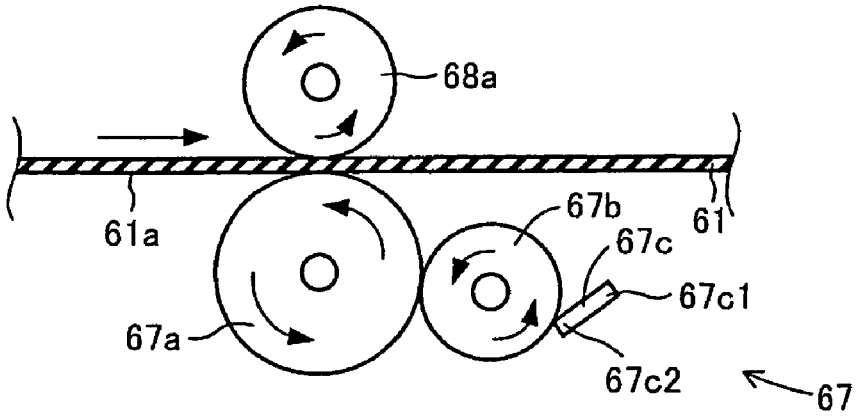
FIG. 6D is an enlarged cross-sectional view of the belt cleaner shown in FIG. 6C, in which a cleaning roller rotates in an opposite direction.

The cleaning unit 67 shown in FIG. 6D has an identical structure to that in FIG. 6C, except that the cleaning roller 67*a* rotates in the opposite direction. This construction has the same operations and effects as those in FIG. 6C.

<Modification of the Cleaning Roller Structure>

Figure 7:
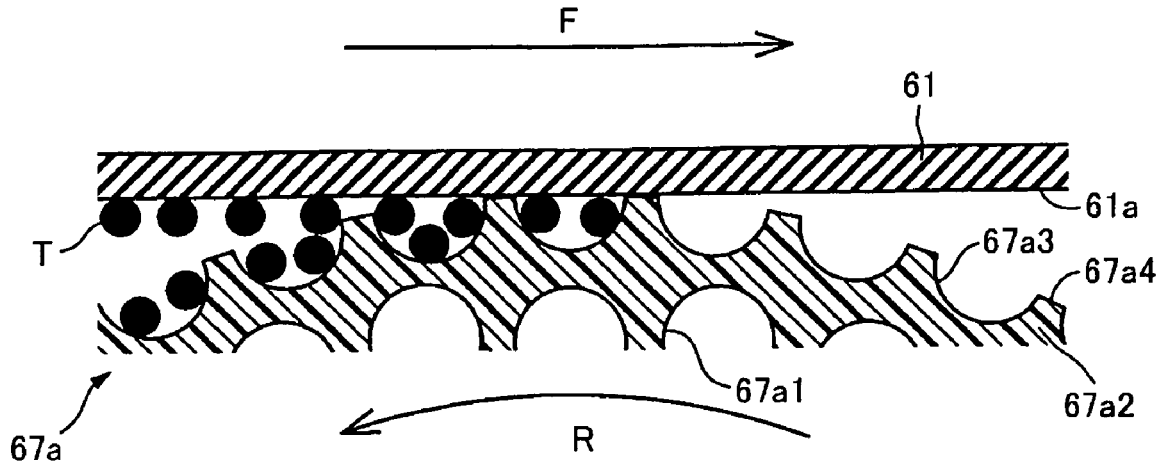
FIG. 7 is an enlarged cross-sectional view showing a peripheral edge of a cleaning roller according to a modification.

Next, a modification of the cleaning roller 67*a*, which can be applied to the illustrative aspects and the modifications described above, will be described with reference to FIG. 7. FIG. 7 is an enlarged vertical cross-sectional view showing a peripheral edge of the cleaning roller 67*a* according to the modification.

In this modification, the cleaning roller 67*a* is formed of a foam synthetic resin such as a foam sponge, having a plurality of cells 67*a*1 formed therein. The outer periphery of the cleaning roller 67*a* is configured of a foam skin 67*a*2. The foam skin 67*a*2 has a plurality of open cells 67*a*3 opening outward from the cleaning roller 67*a*. Protrusions 67*a*4 are formed between adjacent open cells 67*a*3.

In this modification, the cleaning roller 67*a* is driven to rotate in a direction indicated by an arrow R in FIG. 7 that is counter to a conveying direction F of the belt 61.

With this construction, the protrusions 67*a*4 scrape off foreign matter deposited on the outer surface 61*a* of the belt 61, such as a polymerized toner T when the foam skin 67*a*2 is in contact with the outer surface 61*a* of the belt 61, and the polymerized toner T is effectively captured in the open cells 67*a*3, thereby effectively cleaning the outer surface 61*a* of the belt 61.

Conventionally, polymerized toner T that becomes deposited on the outer surface 61*a* of the belt 61 has been difficult to remove therefrom. However, this construction effectively removes the polymerized toner T from the outer surface 61*a* of the belt 61.

Further, it is preferable to use the belt 61 formed of an elastomer, since elastomer has a high mechanical durability. However, foreign matter readily adheres to the elastomer belt 61 due to the coarseness of the belt surface. This structure of the present modification can effectively remove foreign matter deposited on the surface of the belt 61, even when the belt 61 is formed of elastomer.

<State of the Backup Roller>

As described above, a state of the backup roller 68*a* may include the position of the backup roller 68*a* relative to the cleaning roller 67*a*, for example. In this case, the pressing state may indicate a pressing position of the backup roller 68*a* in which the backup roller 68*a* applies pressure to the cleaning roller 67*a* (or the cleaning roller 67*a* applies pressure to the backup roller 68*a*). The pressing release state (see FIG. 2A) may indicate a separated position in which the backup roller 68*a* and cleaning roller 67*a* (and belt 61) are separated a predetermined distance. Alternatively, the pressing release state (see FIGS. 3A, 4A, and 5A) may indicate a position displaced from the pressing position in a direction away from the cleaning roller 67*a* (a very small distance sufficient to relieve the pressure and allow the elastically compressed rollers and belt 61 to be restored to their original shapes) to achieve a state in which the backup roller 68*a* is not actively pressing against the cleaning roller 67*a* (for example, a state in which only the weight of the backup roller 68*a* is entirely or partially applied to the cleaning roller 67*a*).

The state of the backup roller 68*a* may include a pressing state in which the backup roller 68*a* presses against the cleaning roller 67*a* via the belt 61 when the backup roller 68*a* is in constant contact with the inside surface of the belt 61, for example. In this case, the pressing release state (see FIGS. 3A, 4A, and 5A) may include a state in which the backup roller 68*a* is not actively pressing against the cleaning roller 67*a* (for example, a state in which only the weight of the backup roller 68*a* is applied to the cleaning roller 67*a*).

<Suggestions for Other Modifications>

While the invention has been described in detail with reference to specific illustrative aspects and modifications thereof, these were merely considered illustrative aspects by the inventors when applying for a patent. It would be apparent to those skilled in the art that many modifications and variations may be made therein without departing from the spirit of the invention, the scope of which is defined by the attached claims. The following are additional modifications that can be added under the first-to-file principle, but it should be apparent that the invention is not limited to these examples. A limited interpretation of the invention based on the above illustrative aspects and modifications thereof and the following appended modifications is not allowed as it would be unfairly detrimental to the profits of inventors rushing to file under the first-to-file principle, as the invention may be exploited by imitators, and runs counter to the patent law established for the protection and utilization of inventions.

(i) The invention may be applied to other apparatuses than an image forming apparatus and to other types of image forming apparatuses other than a laser printer. Further, the invention may be applied to a monochromatic image forming apparatus that employs only one process cartridge.

(ii) The belt 61 in the illustrative aspects described above may be configured of a plastomer such as polycarbonate or polyimide, or an elastomer such as a synthetic resin. The belt 61 may also be configured of plastomer that is coated with elastomer. The belt 61 may also have a multilayer structure configured of a thin metal plate and a plastomer and/or elastomer. The belt 61 may also function as an intermediate transfer belt for receiving a toner image temporarily transferred from the photosensitive drum 32 and subsequently transferring the toner image onto paper.

(iii) The cleaning roller 67*a* may be configured to contact the outer surface 61*a* of the belt 61 by moving the cleaning unit 67 upward only when the belt 61 is moving.

(iv) The backup unit 68' shown in FIGS. 3A and 3B is configured so that the backup roller 68*a* contacts the inner surface 61*b* of the belt 61 with a weak force in the pressing release state due to the weight of the backup roller 68*a* itself. This construction could also be implemented using the pivoting roller case holder 68*e* shown in FIGS. 2A and 2B, for example. In this case, the raising spring 68*h* could be made weaker or omitted.

(v) Another possible configuration of the belt cleaner 66 is to place the backup roller 68*a* directly over the cleaning roller 67*a* in the pressing release state, as shown in FIG. 3A, and to offset the rotational shaft 68*a*1 of the backup roller 68*a* from the rotational axis of the cleaning roller 67*a* in the pressing state with respect to the horizontal direction (paper-conveying direction), as shown in FIG. 4B. This construction increases the area of contact between the cleaning roller 67*a* and the outer surface 61*a* of the belt 61 in the pressing state.

(vi) The belt cleaner 66 shown in FIGS. 2A and 2B is preferably configured so that the frictional force generated in the region of contact between the secondary roller 67*b* and cleaning blade 67*c* is smaller at both ends in the paper width direction (the direction perpendicular to the surface of the drawing) than at the inner region between the ends (the region corresponding to the "effective width" of the belt 61). Hence, through an extremely simple construction, it is possible to suppress an upward warping (upward bending) of the cleaning blade 67*c* at the both ends in the paper width direction.

Examples of this construction will be described with reference to FIGS. 8A through 9D. FIGS. 8A through 8D show the cleaning roller 67*a*, secondary roller 67*b*, and cleaning blade 67*c* according to modifications when viewed from diagonally above the construction (from a point above and to the left in FIGS. 2A and 2B) In FIGS. 8A through 8D, the two-dot chain lines indicate boundaries of the region corresponding to the "effective width."

Figure 8A:
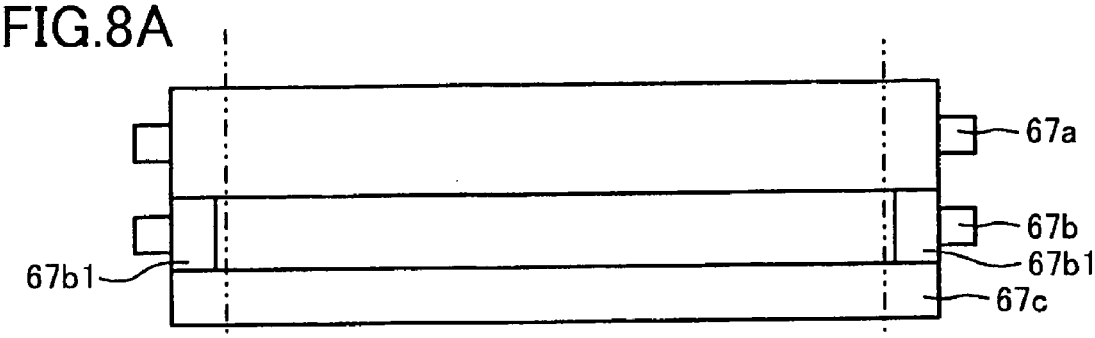
FIG. 8A is an explanatory diagram showing a secondary roller and a cleaning blade according to a modification, in which both ends of the secondary roller is coated with coating.
Figure 9A:
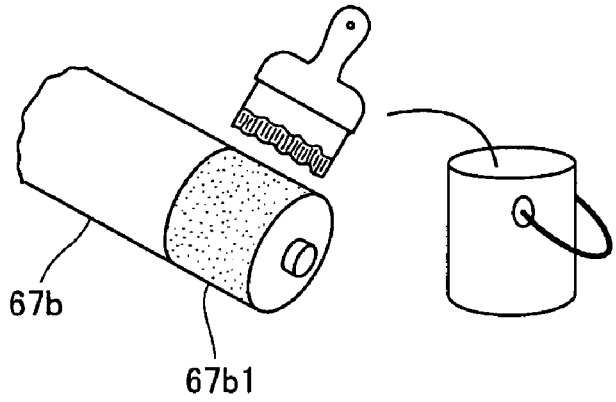
FIG. 9A is an explanatory diagram showing that coating material is applied to the end of the secondary roller shown in FIG. 8A.

As shown in the example of FIGS. 8A and 9A, the peripheral surface of the secondary roller 67*b* at the both ends thereof is coated with coating 67*b*1 formed of a coating material having a low coefficient of friction, such as a fluorocarbon resin. As shown in FIG. 9A, the coating material is applied to the both ends of the secondary roller 67*b*. Alternatively, the coating 67*b*1 may be formed over the entire secondary roller 67*b* in the paper width direction (left-to-right direction in FIG. 8A).

Figure 8B:
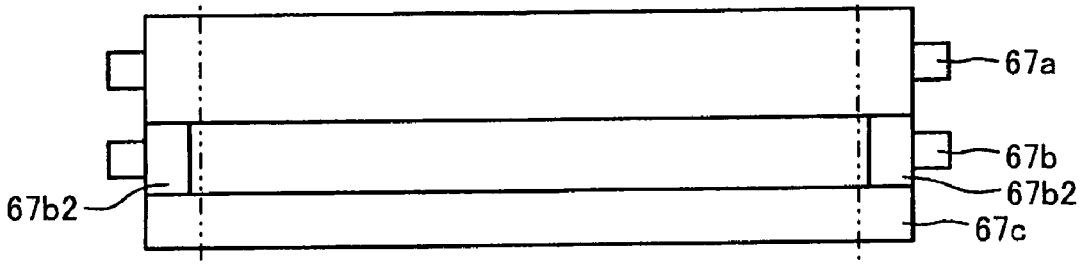
FIG. 8B is an explanatory diagram showing a secondary roller and a cleaning blade according to another modification, in which both ends of the secondary roller is covered with sleeves.
Figure 9B:
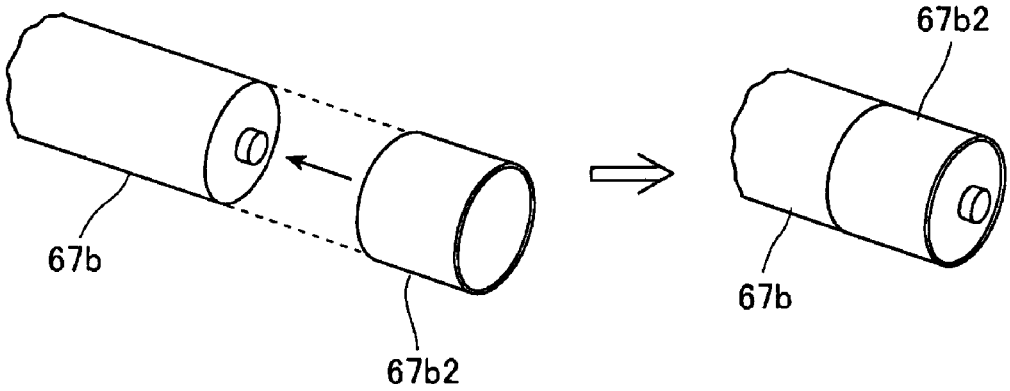
FIG. 9B is an explanatory diagram showing that the sleeves are put over the end of the secondary roller shown in FIG. 8B.

As shown in the example of FIGS. 8B and 9B, the peripheral surface of the secondary roller 67*b* at the both ends thereof is covered with sleeves 67*b*2 configured of a sheet material having a low coefficient of friction. As shown in FIG. 9B, the sleeves 67*b*2 are substantially tube-shaped and are put over the ends of the secondary roller 67*b*. Alternatively, the sleeves 67*b*2 may also be formed over the entire secondary roller 67*b* in the paper width direction. Note that, in FIG. 9B, thickness of the sleeves 67*b*2 is shown to be larger than its actual thickness for explanation purposes.

Figure 8C:
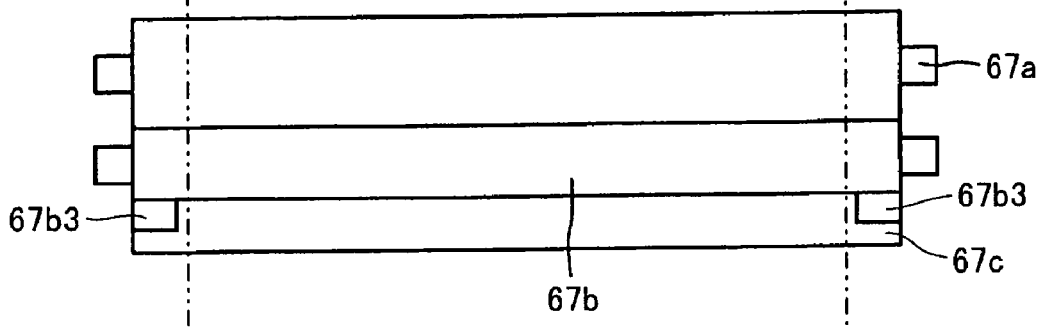
FIG. 8C is an explanatory diagram showing a secondary roller and a cleaning blade according to another modification, in which sheets are put on both ends of the cleaning blade.
Figure 9C:
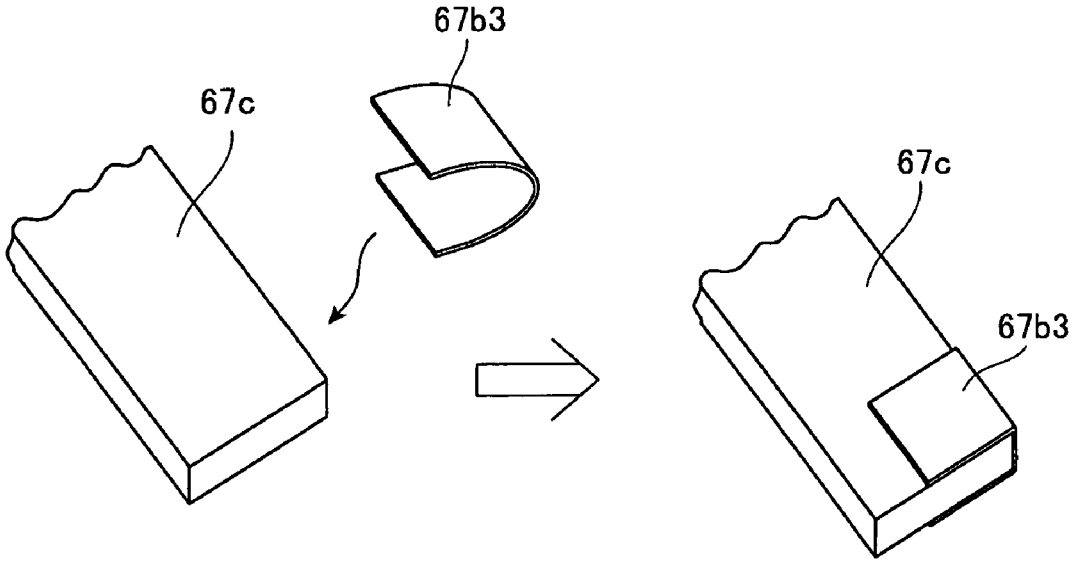
FIG. 9C is an explanatory diagram showing that the sheets are put on the both ends of the cleaning blade shown in FIG. 8C.
Figure 9D:
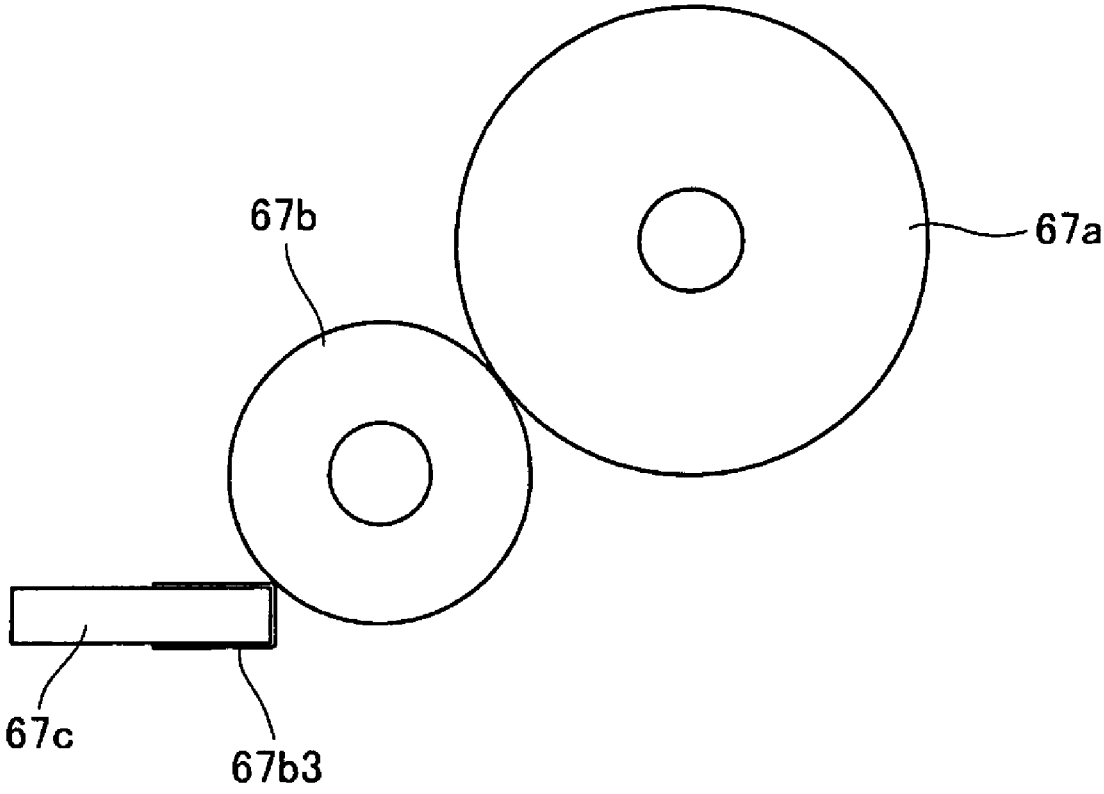
FIG. 9D is a side view showing the secondary roller, cleaning blade, and sheets according to the modification of FIG. 8C.

As shown in the example of FIGS. 8C, 9C, and 9D, sheets 67*b*3 may be inserted between the secondary roller 67*b* and cleaning blade 67*c* at the both ends of the secondary roller 67*b* with respect to the paper width direction. More specifically, as shown in FIG. 9C, the sheets 67*b*3 formed of films are put on the both ends of the cleaning blade 67*c*. The sheets (films) 67*b*3 are formed of a material having a low coefficient of friction. Note that, in FIGS. 9C and 9D, thickness of the sheet 67*b*3 is shown to be larger than its actual thickness for explanation purposes.

Figure 8D:
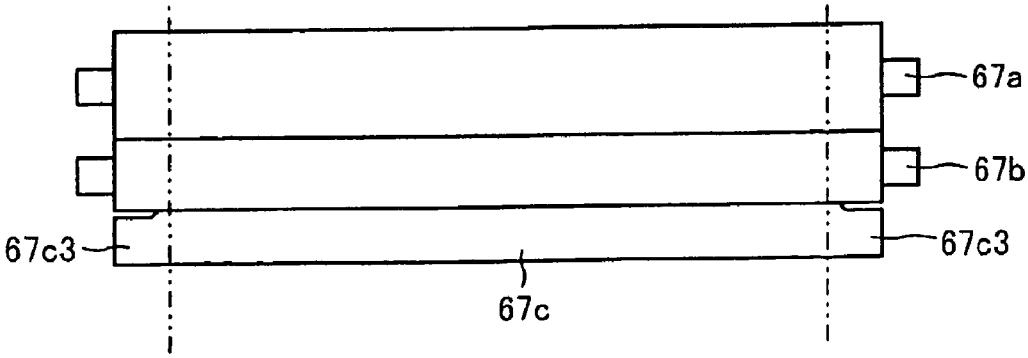
FIG. 8D is an explanatory diagram showing a secondary roller and a cleaning blade according to another modification, in which the cleaning blade has both ends having a shorter dimension.

In the example of FIG. 8D, the cleaning blade 67*c* has both ends 67*c*3 with respect to the paper width direction having a dimension (the dimension orthogonal both to the paper width direction and to the thickness direction of the cleaning blade 67*c*; the vertical dimension in FIG. 8D) that is shorter than the same dimension in the inner region in the paper width direction.

In the structures shown in FIGS. 8A through 9D described above, the coatings 67*b*1, sleeves 67*b*2, sheets 67*b*3, and ends 67*c*3 of the cleaning blade 67*c* are all formed outside the region corresponding to the "effective width" (the region inside the two-dot chain lines in FIGS. 8A through 8D). However, each of these components may be formed such that the inside border of the component in the paper width direction is aligned with the border of the "effective width."

Alternatively, the both ends of the secondary roller 67*b* in the paper width direction may be formed with a smaller diameter than that in the internal region in the paper width direction. The parts of the secondary roller 67*b* having the smaller diameter may be formed in the same regions as the coating 67*b*1 and the like in FIGS. 8A through 8D.

(vii) It is also possible to form the cleaning roller 67*a* in the modification of FIG. 7 with the foam synthetic resin only on the outer periphery of the cleaning roller 67*a*. Further, the foam synthetic resin may have a single-cell property in which neighboring cells 67*a*1 are independent and are not in communication with each other, or may have a continuous-cell property in which adjacent cells 67*a*1 are formed in communication with each other. Also, the cleaning roller 67*a* in the modification of FIG. 7 may be configured to rotate in the opposite direction.

(viii) In addition to the structural examples disclosed in the above illustrative aspects and modifications, the operational and functional components constituting means for solving the problems of the invention may have any structure capable of achieving these operations and functions.

What is claimed is:

1. A belt cleaning device for cleaning a surface of a belt that conveys a conveying object in a conveying direction, comprising:

a cleaning roller disposed in confrontation with the surface of the belt to rotate in a reverse direction of the conveying direction, the cleaning roller being made from a synthetic rubber with a resistance of $10^5$ through $10^7$ ohms;

a backup roller disposed in confrontation with the cleaning roller with the belt interposed between the cleaning roller and the backup roller;

a roller-pressing-state setting mechanism that selectively sets a state of the backup roller to:

a first state in which the backup roller is pressed against the cleaning roller via the belt, allowing a first pressure to be applied between the cleaning roller and the surface of the belt; and a second state in which a second pressure is applied between the cleaning roller and the surface of the belt, the second pressure being less than the first pressure;

a secondary roller having a peripheral surface and disposed in contact with the cleaning roller; and a cleaning blade disposed in contact with the peripheral surface of the secondary roller;

wherein the cleaning roller, the backup roller, the secondary roller, and the cleaning blade are positioned so that a frictional force generated in a region of contact between the secondary roller and the cleaning blade is smaller at both ends in a paper width direction than at an inner region between the both ends to suppress a warping of the cleaning blade at the both ends in the paper width direction.

2. The belt cleaning device according to claim 1, wherein the cleaning roller is in constant contact with the surface of the belt at least when the belt is moving.

3. The belt cleaning device according to claim 1, wherein the cleaning roller is pressed against the surface of the belt, thereby bowing the belt.

4. The belt cleaning device according to claim 1, wherein the cleaning roller is disposed below the surface of the belt when the belt cleaning device is disposed in an orientation in which the belt cleaning device is intended to be used, allowing the surface of the belt to contact the cleaning roller by weight of the belt itself.

5. The belt cleaning device according to claim 1, wherein the cleaning roller is disposed below the surface of the belt when the belt cleaning device is disposed in an orientation in which the belt cleaning device is intended to be used;

wherein the backup roller is disposed above the cleaning roller; and wherein the roller-pressing-state setting mechanism is configured in such a manner that the backup roller contacts the belt by weight of the backup roller itself in the second state.

6. The belt cleaning device according to claim 1, wherein the roller-pressing-state setting mechanism is configured in such a manner that the backup roller is separated from the belt in the second state.

7. The belt cleaning device according to claim 1, further comprising:

a sensor that generates a signal in accordance with a state of the surface of the belt; and a controller that controls the roller-pressing-state setting mechanism to set the state of the backup roller based on the signal generated by the sensor.

8. The belt cleaning device according to claim 1, wherein the cleaning roller has an outer periphery that contacts the surface of the belt and that is configured of a foam skin having open cells.

9. The belt cleaning device according to claim 1, wherein the cleaning roller is driven to rotate in the reverse direction to the conveying direction of the belt.

10. The belt cleaning device according to claim 1, wherein the roller-pressing-state setting mechanism includes:

a roller case;

a roller-case spring having one end and another end, the one end being fixed to the roller case;

a roller shaft holder that rotatably holds the backup roller, the roller shaft holder being fixed to the another end of the roller-case spring; and a cam having a large diameter portion and a small diameter portion; and wherein the large diameter portion confronts the roller case in the first state, and the small diameter portion confronts the roller case in the second state.

11. The belt cleaning device according to claim 1, wherein a center of the cleaning roller and a center of the backup roller are offset in the conveying direction of the belt.

12. The belt cleaning device according to claim 1, wherein a material having a low coefficient of friction is provided on the peripheral surface of the secondary roller at both ends of the secondary roller in the paper width direction.

* * * * *